US008052242B2

(12) United States Patent
Uchiyama et al.

(10) Patent No.: US 8,052,242 B2
(45) Date of Patent: Nov. 8, 2011

(54) IMAGE FORMING APPARATUS AND IMAGE FORMING METHOD

(75) Inventors: Tetsuo Uchiyama, Chiba (JP); Hisashi Ishikawa, Urayasu (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 12/323,296

(22) Filed: Nov. 25, 2008

(65) Prior Publication Data

US 2009/0167803 A1 Jul. 2, 2009

(30) Foreign Application Priority Data

Dec. 26, 2007 (JP) ..... 2007-335058

(51) Int. Cl.
*B41J 2/205* (2006.01)

(52) U.S. Cl. ..... 347/15; 347/41

(58) Field of Classification Search ..... 347/9, 12, 347/15, 16, 37, 41, 43
See application file for complete search history.

(56) References Cited

U.S. PATENT DOCUMENTS

| | | | | |
|---|---|---|---|---|
| 6,036,300 | A | 3/2000 | Suzuki et al. | |
| 6,474,777 | B1 | 11/2002 | Fujita et al. | |
| 6,783,203 | B2 * | 8/2004 | Fujimori | 347/15 |
| 7,548,347 | B2 * | 6/2009 | Kawatoko et al. | 358/3.06 |

FOREIGN PATENT DOCUMENTS

| | | |
|---|---|---|
| JP | 5-309874 | 11/1993 |
| JP | 2001-063015 | 3/2001 |

* cited by examiner

*Primary Examiner* — Thinh Nguyen
(74) *Attorney, Agent, or Firm* — Canon USA Inc IP Division

(57) ABSTRACT

An image forming apparatus which forms a halftone image on a print medium by using a multipass process to scan a printhead N (N is an integer of 2 or more) times in a single area on the print medium and form dots by each scan operation includes a pass division unit which sets the print density of a scan operation in the first pass so as to prevent dots from overlapping with each other on the print medium, and sets the print densities of scan operations in the second to Nth passes, a tone reduction unit which generates print data of the respective scan operations in accordance with the print densities set by the pass division unit, and a printhead which prints a halftone image on a print medium on the basis of the print data generated by the tone reduction unit.

7 Claims, 10 Drawing Sheets

IMAGE FORMING APPARATUS AND IMAGE FORMING METHOD

BACKGROUND OF THE INVENTION

1. Field of the Invention

The present invention relates to an image forming apparatus and image forming method for forming an image on a print medium.

2. Description of the Related Art

Various techniques have been proposed to suppress density nonuniformity caused by variations of printhead characteristics. For example, Japanese Patent Laid-Open No. 5-309874 discloses a technique of setting the number of multiscan operations in accordance with image data to be printed. According to this technique, a high-quality printed image can be obtained without unnecessarily decreasing the print speed.

Japanese Patent Laid-Open No. 2001-063015 discloses a technique of suppressing the print density of the first pass by setting the sum of the ratios of print amounts by odd-numbered scan operations smaller than that of the ratios of print amounts by even-numbered scan operations in a given print area.

Streaks (to be also referred to as streaking hereinafter) may appear in a printed image owing to variations of the orifice diameter, discharge direction, and the like of a printhead. If dots overlap each other within the same pass, streaks often appear more conspicuously than in a case where dots overlap each other in different passes, degrading the print quality. In multipass printing, as described in Japanese Patent Laid-Open No. 5-309874 and Japanese Patent Laid-Open No. 2001-063015, control using mask data and a density correction table cannot prevent overlapping of dots even at low image density. Density nonuniformity, streaking, and the like may stand out.

SUMMARY OF THE INVENTION

The present invention is directed to an image forming apparatus that can form a higher-quality image by suppressing streaking.

According to one aspect of the present invention, there is provided an image forming apparatus which forms a halftone image on a print medium by using a multipass process to scan a printhead N (N is an integer of not less than 2) times in a single area on the print medium and form dots by each scan operation. The apparatus includes: a first print density setting unit configured to set a print density of a scan operation in a first pass so as to prevent dots from overlapping with each other on the print medium; a second print density setting unit configured to set print densities of scan operations in second to (N−1)th passes; a third print density setting unit configured to set a print density of a scan operation in an Nth pass; a print data generation generating print data of respective scan operations in accordance with the print densities set by the first print density setting unit, the second print density setting unit, and the third print density setting unit; and a printing unit printing the halftone image on the print medium on the basis of the print data generated by the print data generation unit.

According to another aspect of the present invention, there is provided an image forming method of forming a halftone image on a print medium by using a multipass process to scan a printhead N (N is an integer of not less than 2) times in a single area on the print medium and form dots in each scan operation. The method includes: a first print density setting step of setting a print density of a scan operation in a first pass so as to prevent dots from overlapping with each other on the print medium; a second print density setting step of setting print densities of scan operations in second to (N−1)th passes; a third print density setting step of setting a print density of a scan operation in an Nth pass; a print data generation step of generating print data of respective scan operations in accordance with the print densities set in the first print density setting step, the second print density setting step, and the third print density setting step; and a printing step of printing the halftone image on the print medium on the basis of print data generated in the print data generation step.

The present invention can form a higher-quality image by suppressing streaking.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

A prior art and exemplary embodiments of the present invention will be described below with reference to the accompanying drawings.

A known example of a conventional apparatus using a printhead with a plurality of printing elements is an inkjet printing apparatus using a printhead with a plurality of ink orifices. In the inkjet printing apparatus, the size and position of dots formed by ink droplets sometimes vary owing to variations of the orifice diameter, discharge direction, and the like, and density nonuniformity may appear in a printed image. An ink droplet will be called a dot, and the size of a dot formed on paper by an ink droplet will be called a dot diameter.

In particular, a serial printing apparatus which prints by scanning a printhead in a direction different from (e.g., perpendicular to) the array direction of a plurality of printing elements suffers density nonuniformity arising from variations of the orifice diameter, discharge direction, and the like.

This density nonuniformity appears as streaks in a printed image, and may degrade the quality of the printed image.

To correct density nonuniformity, it is known to form an image of pixels by one scan operation of an inkjet printhead with ink discharged from different orifices in accordance with image data having undergone a tone reduction process (e.g., a binarization process) using the inkjet printhead. This method is so-called multipass printing of complementing one image by a plurality of scan operations (passes) by feeding paper by an amount smaller than the printhead width.

In multipass printing, generated print data is divided (to be also referred to pass division hereinafter) into a plurality of print data in order to print an image by a plurality of scan operations. For this purpose, mask patterns are prepared in advance by the number of passes. The mask patterns and generated print data are ANDed to generate an actual print pattern. To divide the pass into multiple ones, the mask patterns exclusively determine printable dots for respective passes so that the ORs of dots printable by all passes become equal to each other in all areas.

Data to be actually printed are generated for respective passes by ANDing the mask patterns and generated print data. However, the mask patterns and generated print data are originally independent of each other. The mask patterns are designed to assign print data to respective passes at random when all the dots of print data are generated. To the contrary, generated print data depends on an input image, and the number of dots formed per unit area is small at a bright portion and large at a dark portion. Thus, when performing pass division by ANDing input-dependent print data and mask patterns designed irrespectively of print data, no ideal pass division can be achieved due to interference between the print data and the mask patterns, degrading an image.

Figure 7:
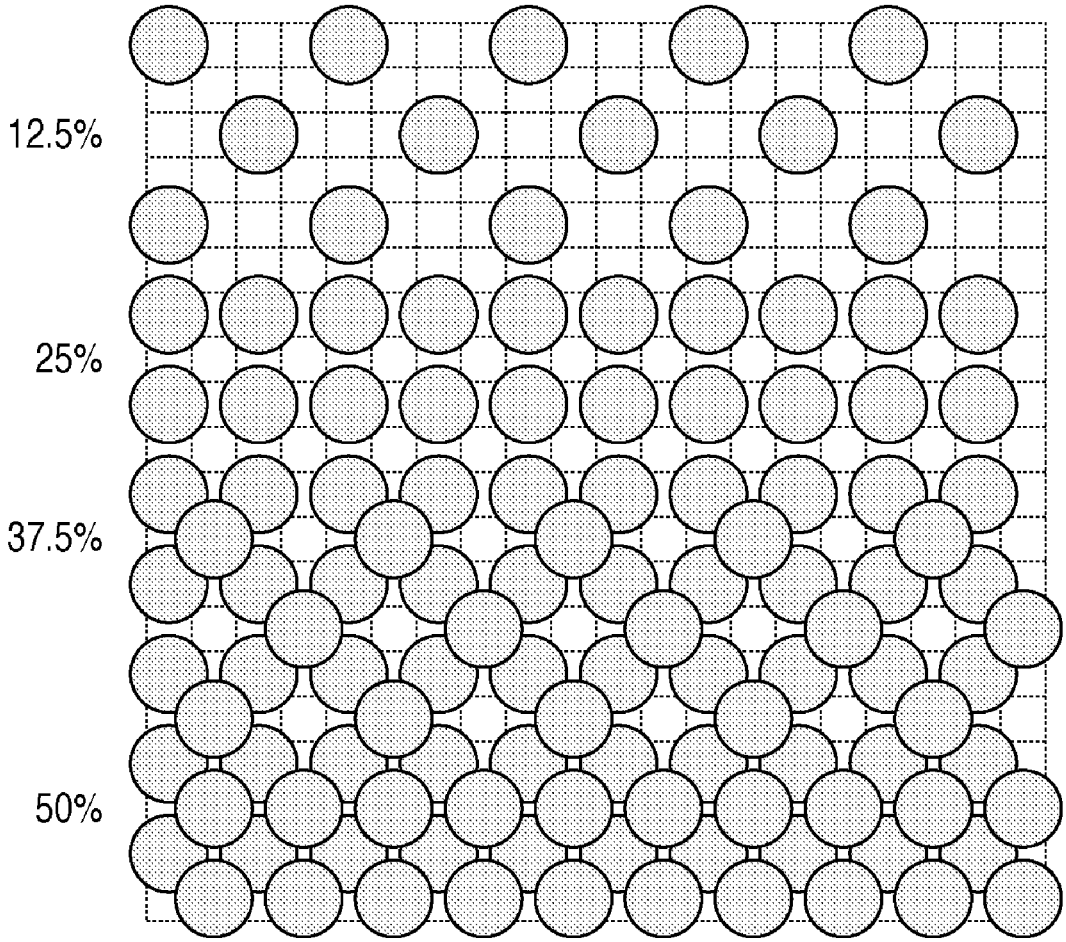
FIG. 7 is a view showing a pixel grid, dots, and the print duty on a print medium.

The relationship between dots for forming an image and the output density will be explained with reference to FIG. 7. FIG. 7 is a view showing a pixel grid, dots, and the print duty (density) on a print medium. The pixel grid is represented by squares defined by broken lines running in the horizontal and vertical directions. Dots are represented by circles to show a state in which dots land on a print medium. Print duties are shown on the left side of the pixel grid. Assume that a print duty of 100% means a state in which ink is discharged to all pixel grid squares. Dot formation positions corresponding to respective print duties shown in FIG. 7 are merely an example, and dot formation positions are not limited to these layouts.

As shown in FIG. 7, the dot diameter is larger than the pixel grid square size. This is because the pixel grid square is rectangular, whereas a dot which lands on a print medium and penetrates it is almost circular, and upon printing at a print duty of 100%, the entire surface of a print medium needs to be printed. Thus, the dot diameter is set larger than the pixel grid square size. However, when actually printing an image on a print medium, mechanical devices such as a paper feed mechanism and inkjet head scanning mechanisms are used. These mechanical devices include control errors. Further, the inkjet head itself includes a discharge error factor. To perform stable printing with these error factors, the dot diameter needs to be further set larger than the pixel grid square size. For this reason, the dot diameter shown in FIG. 7 is set larger than the pixel grid square size.

The diameter of a dot formed on a print medium changes depending on a combination of ink and the print medium. That is, even if the same amount of ink is discharged, the dot diameter changes depending on the print medium. In a general inkjet printer, an ink tank is set and fixed in the printer main body. In contrast, print media vary from a normal sheet to various dedicated sheets, and are selectively used in accordance with the print purpose. It can, therefore, be considered that the diameter of a dot formed on a print medium varies depending on the type of print medium and the like. The relationship between the pixel grid square and the dot diameter shown in FIG. 7 is merely an example, and is not limited to the ratio shown in FIG. 7.

Formation of dots on a print medium by gradually increasing the print duty when printing an image with dots whose diameter is larger than the pixel grid square size will be further explained. In printing at print duties of 12.5% and 25% on the left side in FIG. 7, dots can be printed without overlapping adjacent ones. However, at a print duty of 37.5%, dots overlap each other. At a print duty of 50%, dots cover the most part of a print medium.

Figure 8:
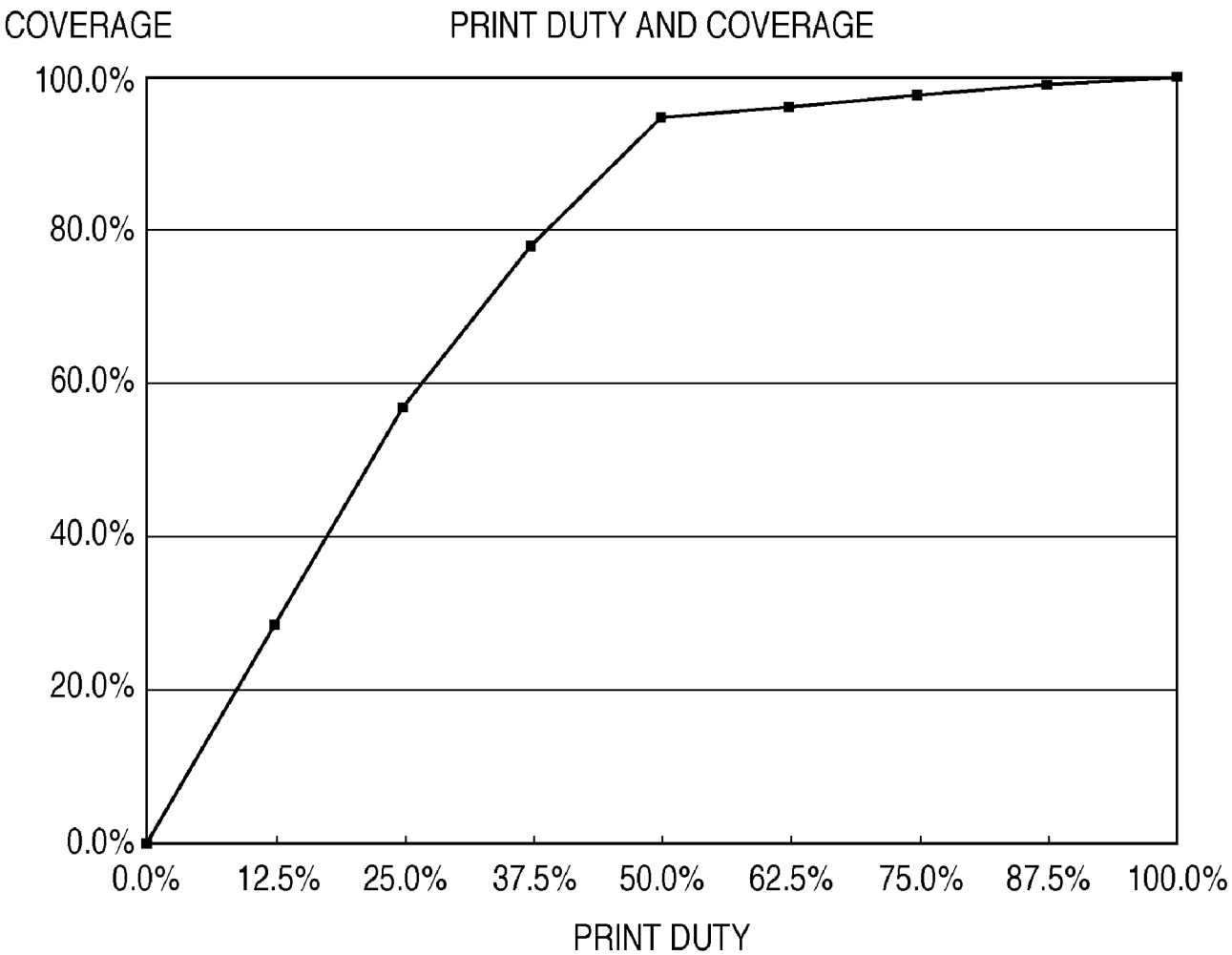
FIG. 8 is a graph showing the relationship between the print duty and the coverage of dots on a print medium.

FIG. 8 is a graph showing the relationship between the print duty and the coverage of dots on a print medium. The abscissa axis represents the print duty, and the ordinate axis represents the coverage of dots on a print medium. FIG. 8 is a graph exemplifying the relationship between the pixel grid square and the dot diameter. In practice, the pixel grid square and dot diameter do not have this ratio. The coverage of dots on a print medium is strongly correlated with the output density though it depends on the type of print medium. Hence, the following description will be based not on the output density, but on the coverage of dots on a print medium.

As shown in FIG. 8, the coverage on a print medium exceeds 90% at a print duty of 50%. If the print duty exceeds 50%, almost no space remains. Even if dots are further formed, the coverage of dots on a print medium hardly rises. Note that some print media have an ink receiving layer coated thick on the surface and allow printing at a coverage of more than 100%. On such a print medium, the output density can rise in accordance with the print amount. However, even such a print medium cannot expect an increase of about 0% to 50% in output density with respect to a print duty of 50% to 100% or more.

As described above, the coverage of dots on a print medium is strongly correlated to the output density. As for the output density, the maximum density is determined by the receiving amount of dots on a print medium. For some kinds of print media (output sheets), the surface of a print medium is coated with a coating layer capable of receiving many dots. On these print media, even if the coverage exceeds 100%, the output density further increases. The output characteristic changes depending on the type of print medium because it depends on the ink receiving amount of a print medium, ink smudge, permeation property, and the like.

Generally in an inkjet printer and the like, the size (pixel pitch) of a printed pixel is not equal to that of a dot formed on a print medium. Considering a mechanical control error, printhead characteristic, and the like, the dot diameter is generally set larger than the pixel grid square size, as shown in FIG. 7. This is because the shape of ink which is discharged from an inkjet head and lands on a print medium is almost circular, and a mechanical control error and the like exist. As shown in FIG. 8, the number of dots discharged per unit area and the output density on a print medium do not have a linear relationship.

When print data is uniformly assigned to respective passes in multipass printing, and the first pass most influences the output density, and the second and subsequent passes less influence the density. Assume that, when printing an input image by four passes, the image is printed uniformly at 25% by the four passes. The first 25% image is printed by the first pass, and the next 25% image is printed by the second pass. A total of 50% image is theoretically printed by the first and second passes. However, 90% or more of the area on the print medium has already been covered, though it depends on the dot diameter. Multipass printing distributes various error factors (e.g., a mechanical paper feed error and inkjet head nozzle variations), and makes degradation of the image quality caused by error factors less conspicuous. However, print operations by respective passes do not uniformly influence the output density, but a print operation by the first pass most influences it.

Figure 9:
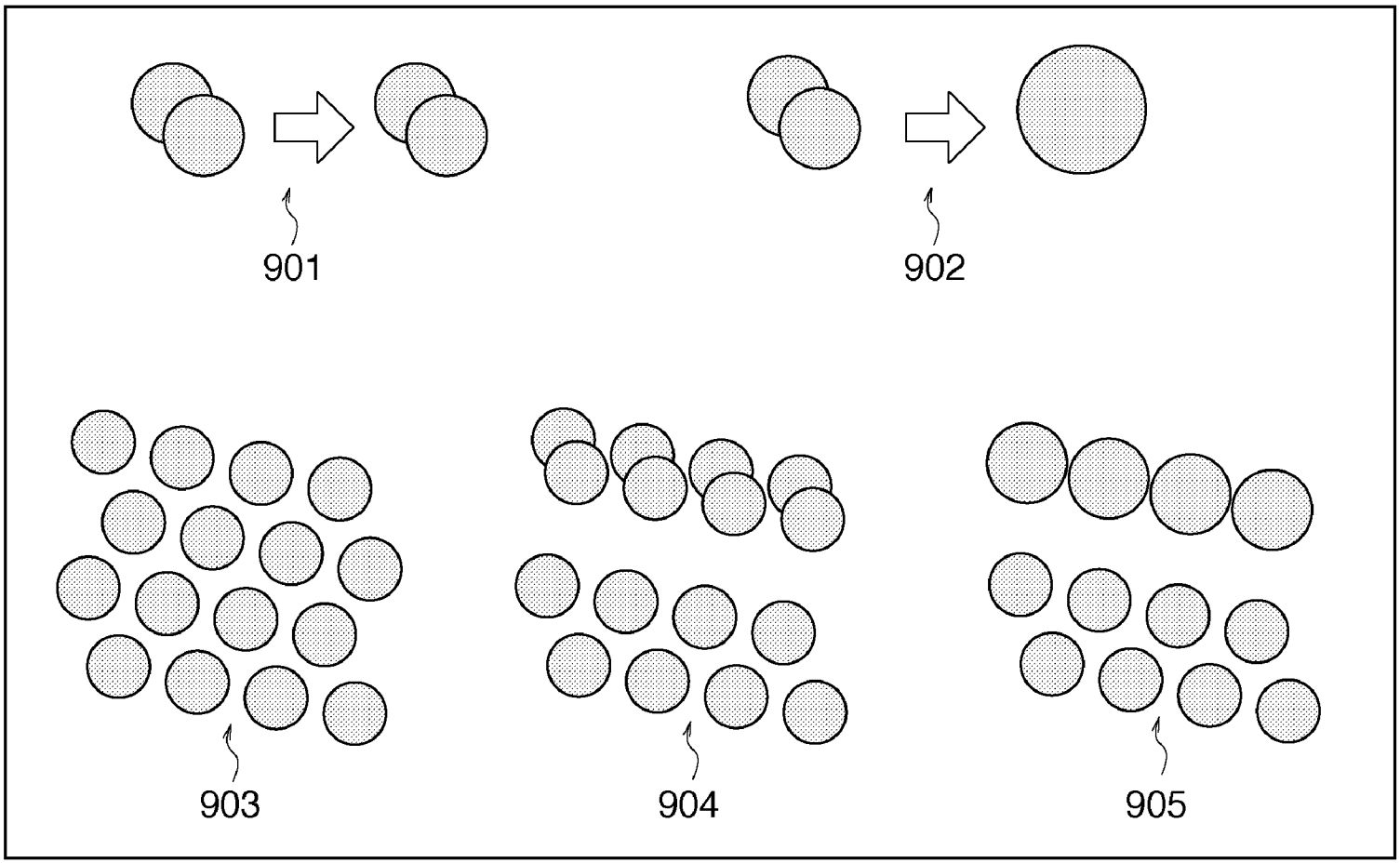
FIG. 9 is a view showing overlapping of dots.

FIG. 9 is a view showing overlapping of dots. Reference numeral 901 denotes a state in which dots overlap each other with a time difference. Reference numeral 902 denotes a state in which dots overlap each other within a short time. When dots are printed by different passes, they are printed with a time difference. A dot printed by a preceding pass is fixed before a dot is printed by the following pass, so the shape of each dot is held, as represented by reference numeral 901. However, when dots printed by the same pass overlap each other, as represented by reference numeral 902, they overlap before a previously discharged dot is fixed. These dots attract each other and are printed as one dot on a print medium.

It is ideal to uniformly print dots by the same pass without any density nonuniformity, as represented by reference numeral 903. However, dots are discharged to positions represented by reference numeral 904 due to variations between nozzles. If dots overlap each other by the same pass, they attract each other before they are dried and fixed. As a result, overlapping dots form one dot, generating streaks, as represented by reference numeral 905.

Exemplary embodiments of a technique of printing an image on a print medium while preventing overlapping of dots by the first pass in order to suppress streaking and the like and form a higher-quality image will be described.

First Embodiment

Figure 1:
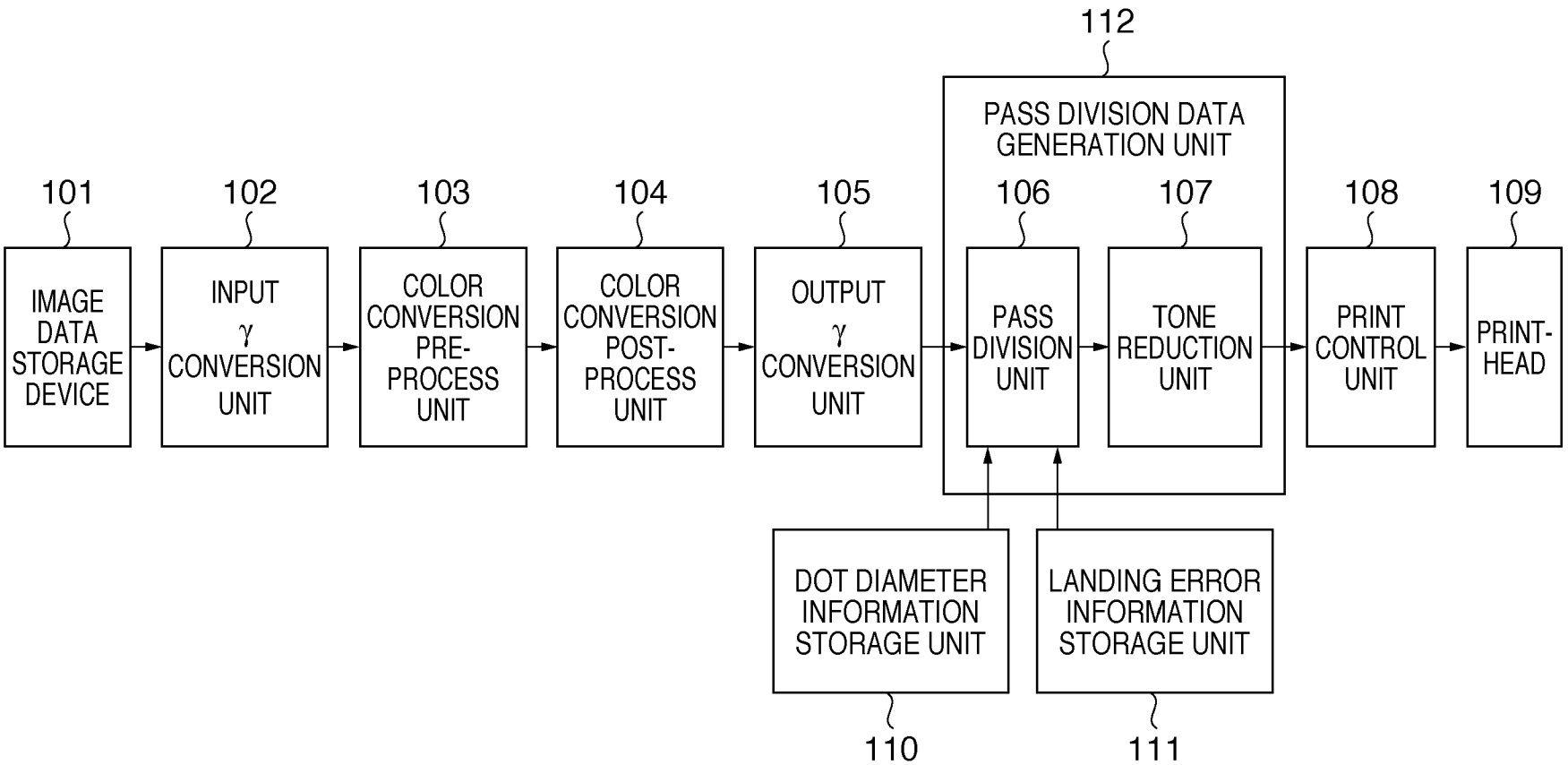
FIG. 1 is a block diagram showing the functional arrangement of an image forming apparatus 100 according to the first embodiment of the present invention.

FIG. 1 is a block diagram showing the functional arrangement of an image forming apparatus 100 according to the first embodiment of the present invention. The image forming apparatus 100 forms a halftone image on a print medium by using a multipass process to scan a printhead N (N is an integer of 2 or more) times in a single area on the print medium and form dots by each scan operation. The image forming apparatus comprises functional units 101 to 109.

The image data storage device 101 stores multilevel image data transferred from a host computer, reads out data for each band, and inputs it to the input γ conversion unit 102. The input γ conversion unit 102 γ-converts input image data into a linear luminance signal. The color conversion pre-process unit 103 performs RGB→RGB color conversion (color matching) by using a multilevel RGB→multilevel RGB lookup table. The color conversion post-process unit 104 performs RGB→CMYK color conversion (output device color separation) by using a lookup table (grid point data) and interpolation unit. The output γ conversion unit 105 performs output γ correction for multilevel data having undergone CMYK color conversion by the color conversion post-process unit 104.

The pass division unit 106 divides multilevel CMYK data formed by the color conversion post-process unit 104 into pass data for multipass printing. The dot diameter information storage unit 110 stores information (dot diameter information) on the diameter of a dot formed on a print medium. The dot diameter is determined by the ink discharge amount of a printhead, the print medium, and the ink penetration characteristic. The landing error information storage unit 111 stores information (landing error information) on the error of a dot from a landing reference position. When the present invention is applied to an inkjet printer, the dot diameter information and landing error information may also be stored in the memory of an ink tank.

Based on the dot diameter information stored in the dot diameter information storage unit 110 and the landing error information stored in the landing error information storage unit 111, the pass division unit 106 sets the maximum density of the first pass, and sets a pass division coefficient for the second and subsequent passes in accordance with the maximum density of the first pass. The pass division unit 106 functions as the first print density setting unit for setting the print density of a scan operation by the first pass so as to prevent dots from overlapping each other on a print medium, and the second print density setting unit for setting the print densities of scan operations by the second to (N−1)th passes. The pass division unit 106 also functions as the third print density setting unit for setting the print density of a scan operation by the Nth pass.

The tone reduction unit 107 converts multilevel data into the number of tones (e.g., binary data) outputtable by the printhead by random dithering or the like. The tone reduction unit 107 functions as a print data generation unit for generating print data of respective scan operations in accordance with the print densities set by the first, second, and third print density setting unit. A combination of the pass division unit 106 and tone reduction unit 107 will be called a pass division data generation unit 112. The print control unit 108 converts binary image data into printhead driving data. The printhead 109 is, for example, the head of an inkjet printer, and prints by discharging ink from nozzles on the basis of driving data converted by the print control unit 108. The printhead 109 functions as a printing unit for printing on a print medium on the basis of print data generated by the print data generation unit.

Figure 2:
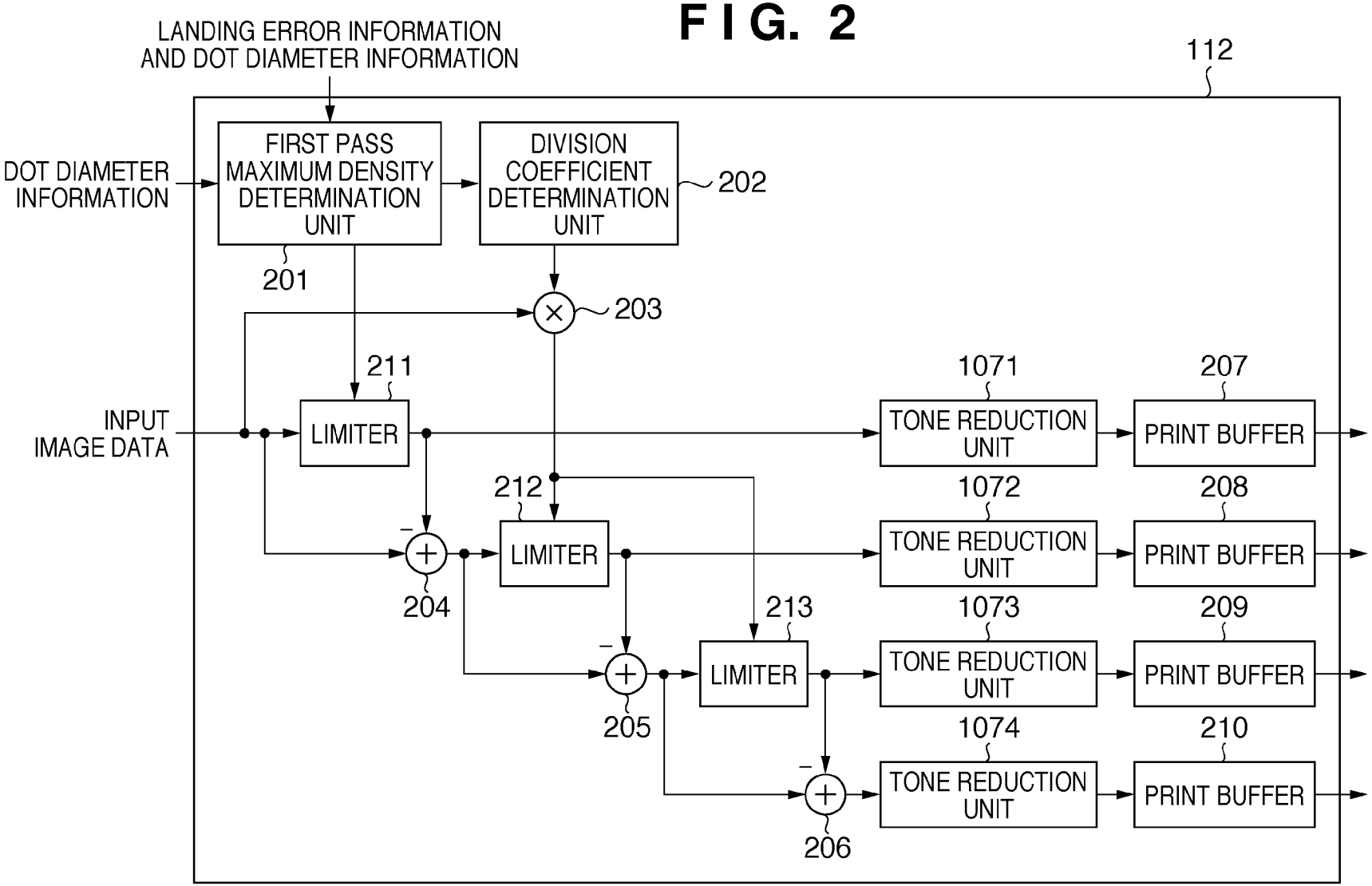
FIG. 2 is a block diagram showing the detailed functional arrangement of a pass division data generation unit 112.

FIG. 2 is a block diagram showing the detailed functional arrangement of the pass division data generation unit 112. A first pass maximum density determination unit 201 determines the maximum density of the first pass based on dot diameter information and landing error information. A division coefficient determination unit 202 determines a division coefficient K2 for the second and subsequent passes based on the determination result of the first pass maximum density determination unit 201. A multiplier 203 multiplies input image data by the division coefficient K2 determined by the division coefficient determination unit 202.

A limiter 211 limits input image data to be equal to or smaller than the maximum density determined by the first pass maximum density determination unit 201. A subtracter 204 subtracts the density of the first pass from input image data. A limiter 212 limits an output from the subtracter 204 to be equal to or smaller than the output density of the multiplier 203. A subtracter 205 subtracts the density of the second pass from an output from the subtracter 204. A limiter 213 limits an output from the subtracter 205 to be equal to or smaller than the output density of the multiplier 203. A subtracter 206 subtracts the density of the third pass from an output from the subtracter 205. Tone reduction units 1071, 1072, 1073, and 1074 reduce image signals for respective passes to obtain the number of tones outputtable by the printhead. Print buffers 207, 208, 209, and 210 temporarily store, as outputs, the results of tone reduction processes executed by the tone reduction units 1071, 1072, 1073, and 1074 corresponding to the respective passes.

Dot diameter information and landing error information shown in FIG. 1 are selected or their values are set by a CPU (not shown) or the like. Based on these pieces of information, the first pass maximum density determination unit 201 determines the maximum density of the first pass.

A sequence to determine the maximum density of the first pass by the first pass maximum density determination unit 201 based on dot diameter information and landing error information will be explained.

Figure 3B:
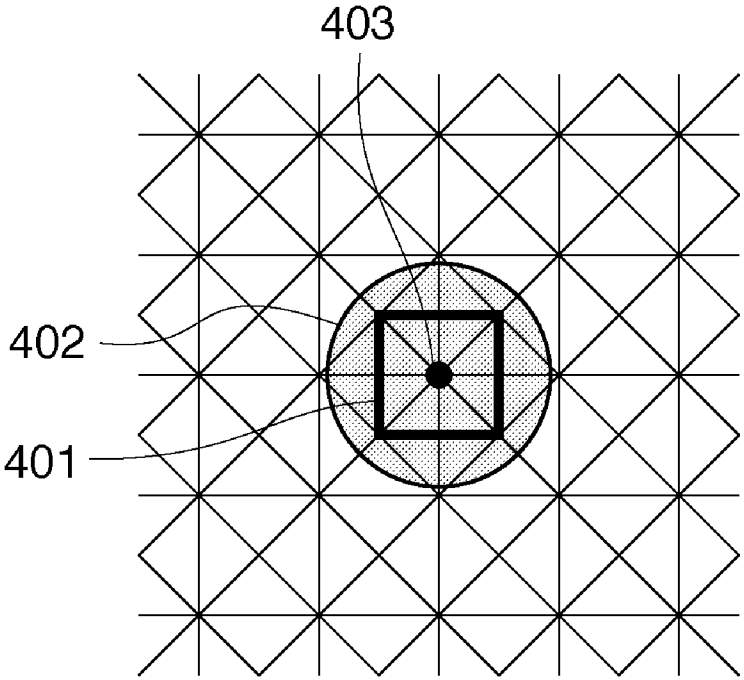
FIGS. 3A and 3B are views showing the relationship between a pixel grid square and a dot.
Figure 3A:
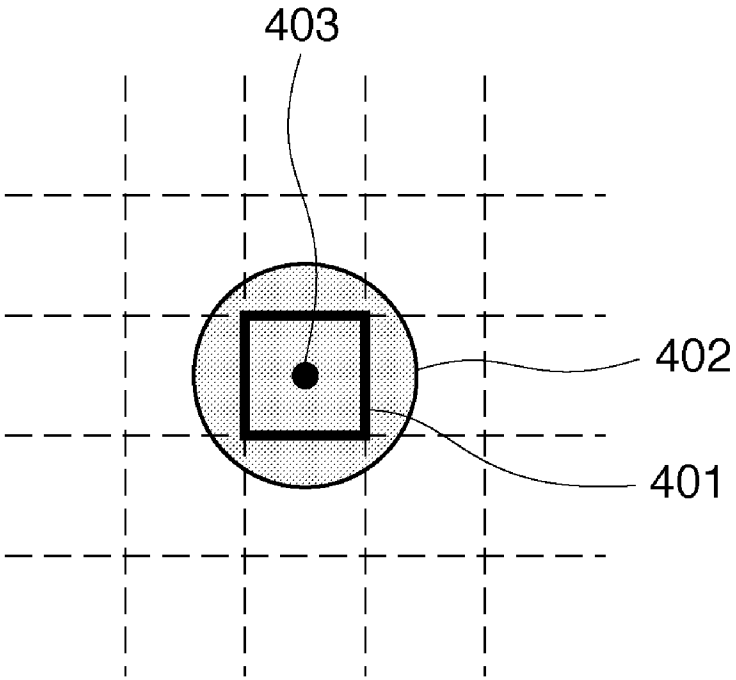

FIGS. 3A and 3B are views showing the relationship between a pixel grid square and a dot. A pixel grid square 401 corresponds to one pixel, and a dot 402 is formed at an ideal position on the pixel grid square 401. As described above, the actual diameter of a dot formed on a print medium is larger than the size of the pixel grid square 401.

As shown in FIG. 3A, the pixel grid square 401 is defined by broken lines, and the dot 402 is arranged on the pixel grid square 401. As shown in FIG. 3B, the intersection point of diagonals of the pixel grid square 401 is a barycenter 403 of each pixel grid square representing the center of the dot. In other words, the barycenter 403 represents the center of a dot formed at an ideal position.

The size of the dot 402 changes depending on the print medium for use and the amount of droplet discharged from a nozzle, and is stored in advance as dot diameter information. In the first embodiment, the dot is circular, and dot diameter information is given by a radius r.

Figure 4:
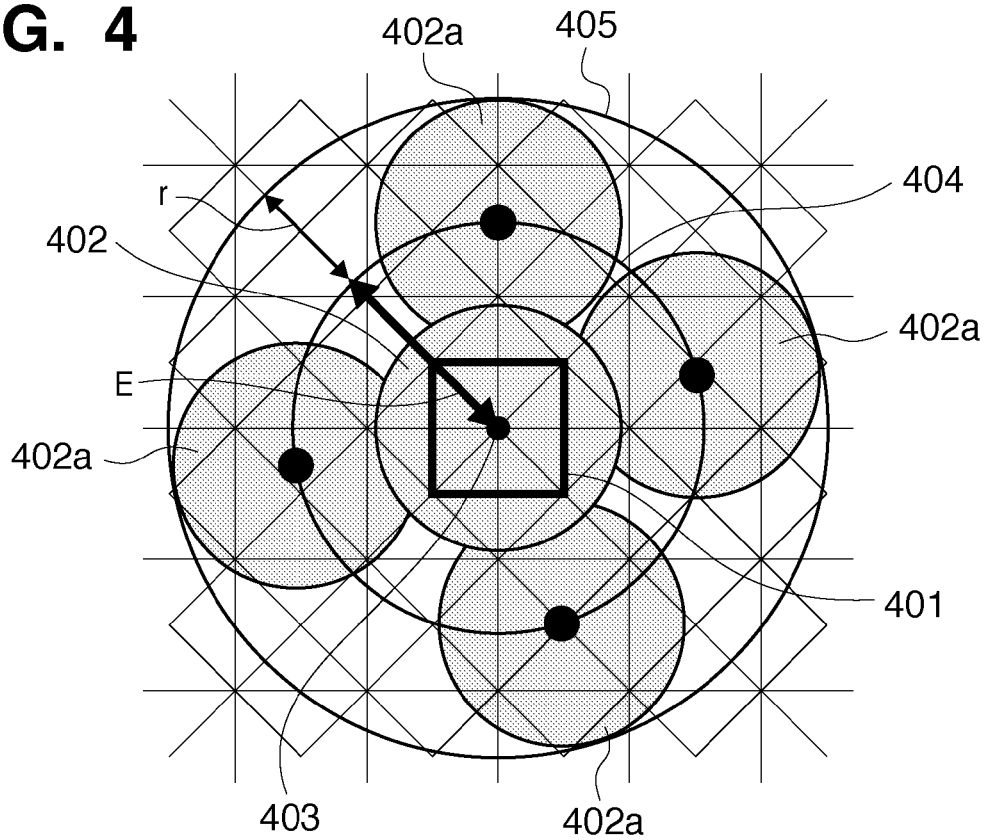
FIG. 4 is a view showing an example of forming a dot with a maximum error from the barycenter of a pixel grid square.

FIG. 4 is a view showing an example of forming the dot 402 with a maximum error from the barycenter 403 of the pixel grid square. The barycentric position where a dot is formed changes depending on the nozzle characteristic and mechanical precision, but falls within a circle 404 having a radius E at maximum. The maximum error E is defined as landing error information. The landing error information may also be stored in advance by detecting the position error of an ink orifice in the manufacture.

When the center of the dot 402 is positioned on the circle 404 (i.e., a dot is formed with the maximum error), a circle 405 with a radius E+r which circumscribes a dot 402*a* and is centered on the barycenter 403 serves as a range where the dot can be landed on the pixel grid square 401. This range will be called a dot landing range 405. The coefficient of the first pass is determined based on the radius E+r of the dot landing range.

Figure 5:
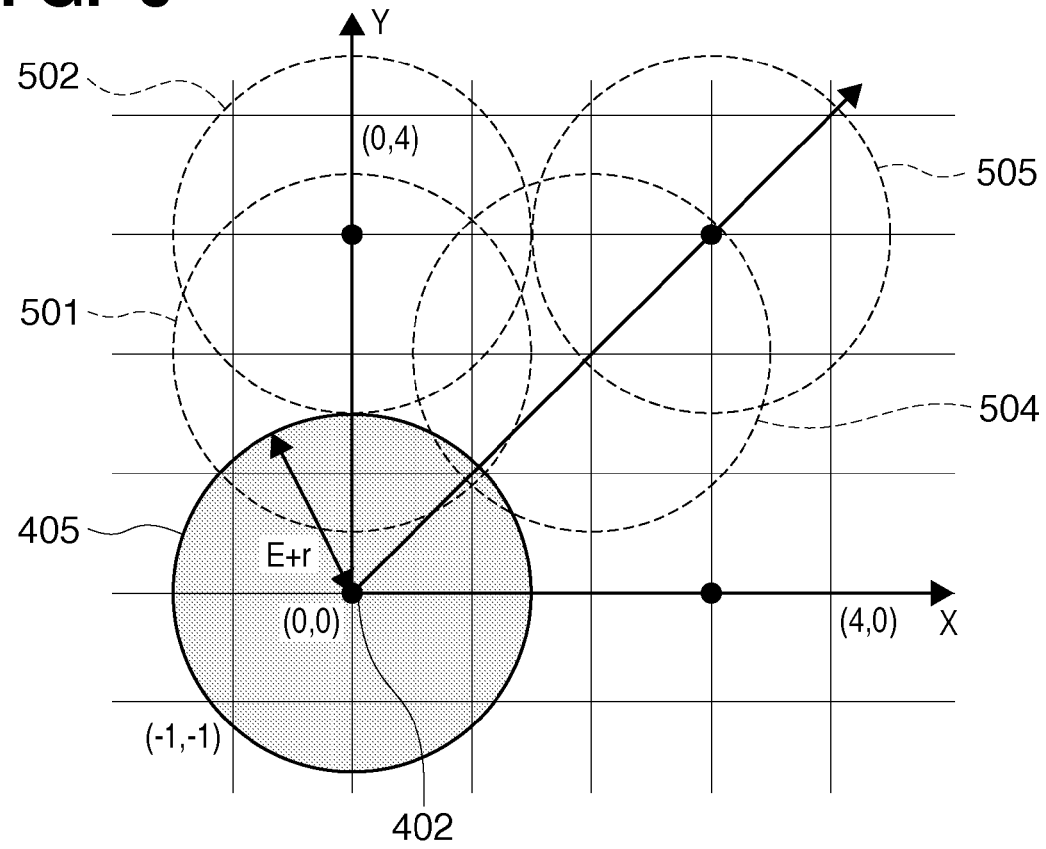
FIG. 5 is a view showing the relationship between the dot landing range and the search direction.
Figure 6B:
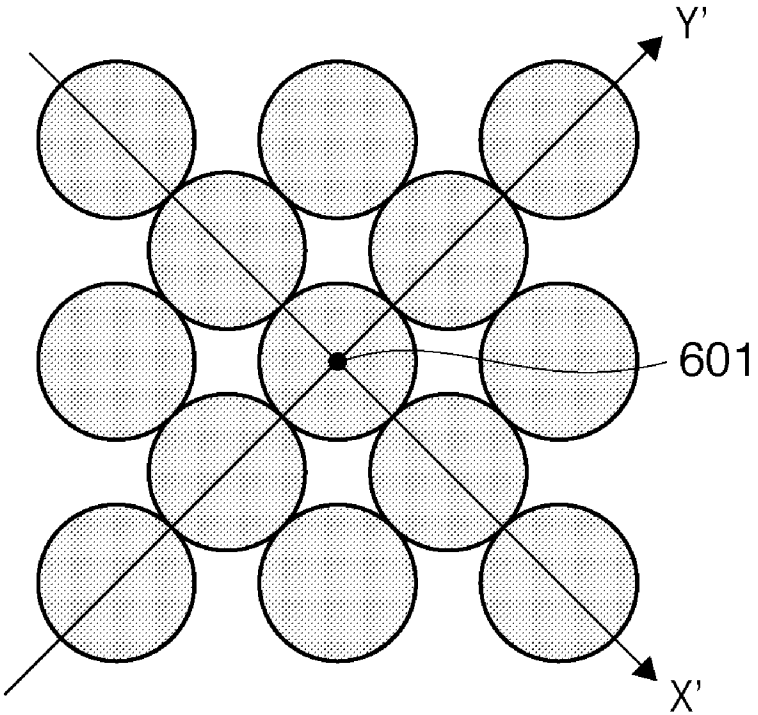
FIGS. 6A and 6B are views showing dot layouts each having a maximum dot density.
Figure 6A:
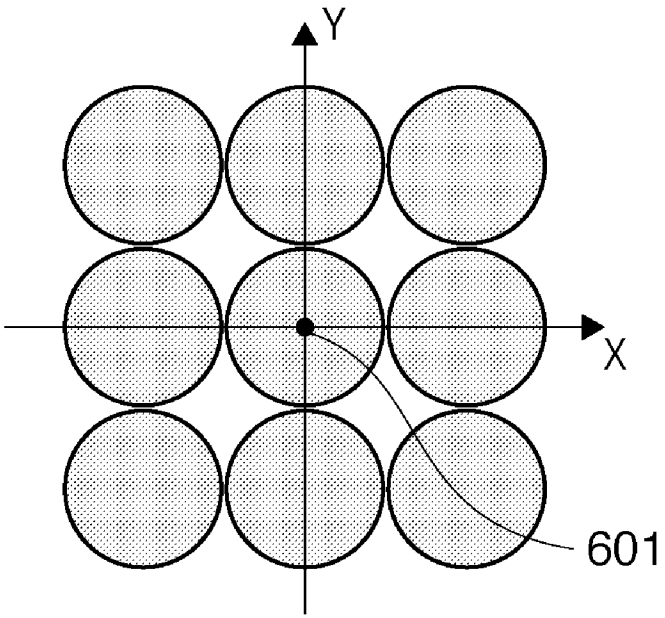

FIG. 5 is a view showing the relationship between the dot landing range and the search direction. FIGS. 6A and 6B are views showing dot layouts each having a maximum dot density. Each coordinate point shown in FIG. 5 indicates a dot landing reference position corresponding to each pixel grid square. When the landing reference position of the dot 402 having the radius r is set at the origin (0,0), the landing range of the dot 402 is given by a circle having the radius E+r.

When dots are laid out to prevent overlapping of dots as much as possible, there are two patterns shown in FIGS. 6A and 6B each having a maximum dot density: a pattern in which dots are arranged in a square grid, as shown in FIG. 6A, and a pattern in which dots are rotated through 45° about a center point 601 from the layout shown in FIG. 6A, as shown in FIG. 6B. Hence, there are two types of printable coordinate search directions: four, horizontal directions (defined as X directions) and vertical directions (defined as Y directions), and four directions (defined as X' and Y' directions) inclined by 45° from the X and Y directions.

A sequence to search for a grid point at which no dot landing ranges overlap each other in the X and Y directions will be explained. A coordinate point (0,1) falls within the dot landing range 405 centered at the coordinate point (0,0), and no printing can be done. A circle 501 represents a dot landing range centered at a coordinate point (0,2). This dot landing range overlaps the dot landing range 405, dots may overlap each other, so no printing can be done. A circle 502 represents a dot landing range centered at a coordinate point (0,3). This dot landing range does not overlap the dot landing range 405, and printing can be done at the coordinate point (0,3). In this case, T1 (T1=3 in FIG. 5) represents the distance between the center (0,0) of the dot landing range 405 and the newly printable grid point (0,3) closest to (0,0) in the X and Y directions.

Similarly, a grid point where no dot landing ranges overlap each other in the Y' direction is searched for. Then, a circle 504 centered at a coordinate point (2,2) overlaps the dot landing range 405, dots may overlap each other, so no printing can be done. A circle 505 centered at a coordinate point (3,3) does not overlap the dot landing range 405, and printing can be done at the coordinate point (3,3). In this case, T2 (T2=$3\sqrt{2}$ in FIG. 5) represents the distance between the center (0,0) of the dot landing range 405 and the newly printable grid point (3,3) closest to (0,0) in the Y' direction. The obtained distances are applicable to the remaining three of the X and Y directions, and the remaining three of the X' and Y' directions. Thus, distances suffice to be obtained in one of the X and Y directions and one of the X' and Y' directions.

T1 and T2 are compared with each other, and a smaller (closer) distance is defined as the search direction. Since T1<T2, printable grid points are searched for in the X and Y directions. In this case, a square defined by (0,0), (0,3), (3,3), and (3,0) serves as a unit. That is, only one dot can be discharged within 3×3 grid points. Assume that the density obtained by forming dots at all 3×3 grid points is 255, and the output density is proportional to the number of dots. In this case, the maximum density under a condition that no dots overlap each other is 255/(3×3)=28.33. . . . By limiting the density to 28 or less, dots can be laid out without overlapping each other even with a landing error. Hence, the maximum density output from the first pass maximum density determination unit 201 is 28. When the maximum density of input image data is 28 or less, the input image data itself expresses the density of the first pass. When the maximum density of input image data is 29 or more, the limiter 211 limits the maximum density to 28, and this value serves as the density of the first pass.

When E+r=$1.4 \leqq \sqrt{2}$, the dot diameter is maximized in the layout of FIG. 6B. The density of dots printable without overlapping each other is $255/(2\sqrt{2}\times 2\sqrt{2})=31.875$. Thus, the maximum density output from the first pass maximum density determination unit 201 is 31.

In this manner, the first pass maximum density determination unit 201 calculates, based on dot diameter information and landing error information, the density of dots printable without overlapping each other, determining the maximum density of the first pass. The division coefficient determination unit 202 determines the division coefficient of the second and subsequent passes from the maximum density of the first pass determined by the first pass maximum density determination unit 201.

For example, let M be the maximum value of an input density, K1 be an output from the first pass maximum density determination unit 201, and P be the number of passes. When making the densities of the second and subsequent passes almost equal to each other, the coefficient K2 determined by the division coefficient determination unit 202 can be calculated by $$K2=(M-K1)/(M\times(P-1)) \quad (1)$$

For example, when M=255, K1=28, and P=4, K2=(255−28)/(255×(4−1))=0.2967. . . . This value undergoes 8-bit right shift operation, 0.2967 . . . ×256=75.9633. . . . The division coefficient determination unit 202 outputs 76. The multiplier 203 multiplies input image data by the coefficient K2, extracts the integer part (the result of the 8-bit right shift operation), and inputs it to the limiters 212 and 213. The limiter 212 sets, as the density of the second pass, a value obtained by limiting, to 76 or less as an output from the multiplier 203, an output from the subtracter 204 as a result of subtracting the density of the first pass from the input image data. Similarly, the limiter 213 sets, as the density of the third pass, a value obtained by limiting, to 76 or less as an output from the multiplier 203, an output from the subtracter 205 as a result of subtracting the densities of the first and second passes from the input image data. The residual of the first to third pass densities from the input image data is assigned as the density of the fourth pass serving as the final pass.

In the first embodiment, the density of each pass uses the difference between input and output data of a limiter corresponding to an immediately preceding pass. Alternatively, the density of each pass may also be directly generated from an output from the first pass maximum density determination unit 201, an output from the division coefficient determination unit 202, and input image data. This is effective in some cases because each print pass corresponding to a plurality of nozzles aligned in a printhead changes for each area corresponding to the paper feed amount, and input image data also changes depending on the nozzle. In this case, the capacities of the print buffers 207, 208, 209, and 210 corresponding to the first, second, third, and fourth passes can be reduced.

The coefficient K2 determined by the division coefficient determination unit 202 is not limited to the calculation method based on the above-described equation (1), but the reciprocal of the number of passes may also be calculated. Particularly when the number of passes is a power of two (e.g., 2 or 4 passes), the multiplier 203 can be formed from a shifter. Since dots corresponding to a shortage from the cumulative number of dots are formed by the final pass, no round-down need be done.

When the difference between input and output data of a limiter becomes 0, the densities of passes subsequent to a pass corresponding to the limiter become 0, so printing by the subsequent passes is omitted. The number of passes can be changed for each scanning of the printhead, achieving high-speed printing. For example, when the difference between input and output data of the limiter 213 corresponding to the third pass becomes 0 in all pixels within scanning, printing by the fourth pass can be omitted. Similarly, when the difference between input and output data of the limiter 212 corresponding to the second pass becomes 0 in all pixels within scanning, printing by the third and subsequent passes can be omitted. Further, when the difference between input and output data of the limiter 211 corresponding to the first pass becomes 0 in all pixels within scanning, printing by the second and subsequent passes can be omitted. That is, when it is detected that an output from the subtracter 204, 205, or 206 becomes 0 in all pixels within scanning, printing by the corresponding pass and subsequent passes can be omitted. Hence, the limiters 211 to 213 function as a detection unit for detecting whether formation of all dots has ended by immediately preceding scanning.

The tone reduction units 1071, 1072, 1073, and 1074 convert densities assigned to the respective passes into the number of tones expressible by the printhead. The print buffers 207, 208, 209, and 210 store the output data. In accordance with the output data stored in the print buffers, the printhead is driven in synchronism with scanning of a carriage supporting the printhead, forming an image on a print medium.

The first embodiment has exemplified the use of dot diameter information and landing error information. However, the present invention is not limited to this embodiment, and these pieces of information may also be set in accordance with a print medium for printing an image. In general, ink and the printhead are not frequently exchanged, so the dot diameter depends on only the print medium. The maximum value of a landing error is determined by the head positioning precision and the like, does not greatly vary in each printing process, and is not effectively decreased by the above-described arrangement.

The tone reduction units 1071, 1072, 1073, and 1074 convert densities into the number of tones outputtable by the printhead. For example, when dark and light inks are used, or a plurality of droplets with different discharge amounts are used, the process by the tone reduction units 1071, 1072, 1073, and 1074 includes an N-ary (N is an integer of 2 or more) process for reducing the data amount, and is not limited to binarization. A concrete method of reducing the number of tones is random dithering or a dither matrix.

As described above, according to the first embodiment, the maximum density of the first pass at which no dots overlap each other is calculated based on dot diameter information and landing error information. The print density of the first pass can be limited to be equal to lower than the maximum density at which no dots overlap each other. As a result, overlapping of dots which causes streaking or a decrease in density can be prevented in printing by the first pass which most influences the image quality, improving the image quality. When the maximum value of input image data for one scan operation is equal to or smaller than the maximum density determined by the first pass maximum density determination unit 201, printing can be completed by only the first pass, increasing the print speed.

In the first embodiment, printing is completed by scanning by four print passes. However, the present invention is applicable by increasing/decreasing the numbers of subtracters, limiters, tone reduction units, print buffers, and the like regardless of the number of print passes as long as multipass printing is employed.

Second Embodiment

Figure 10:
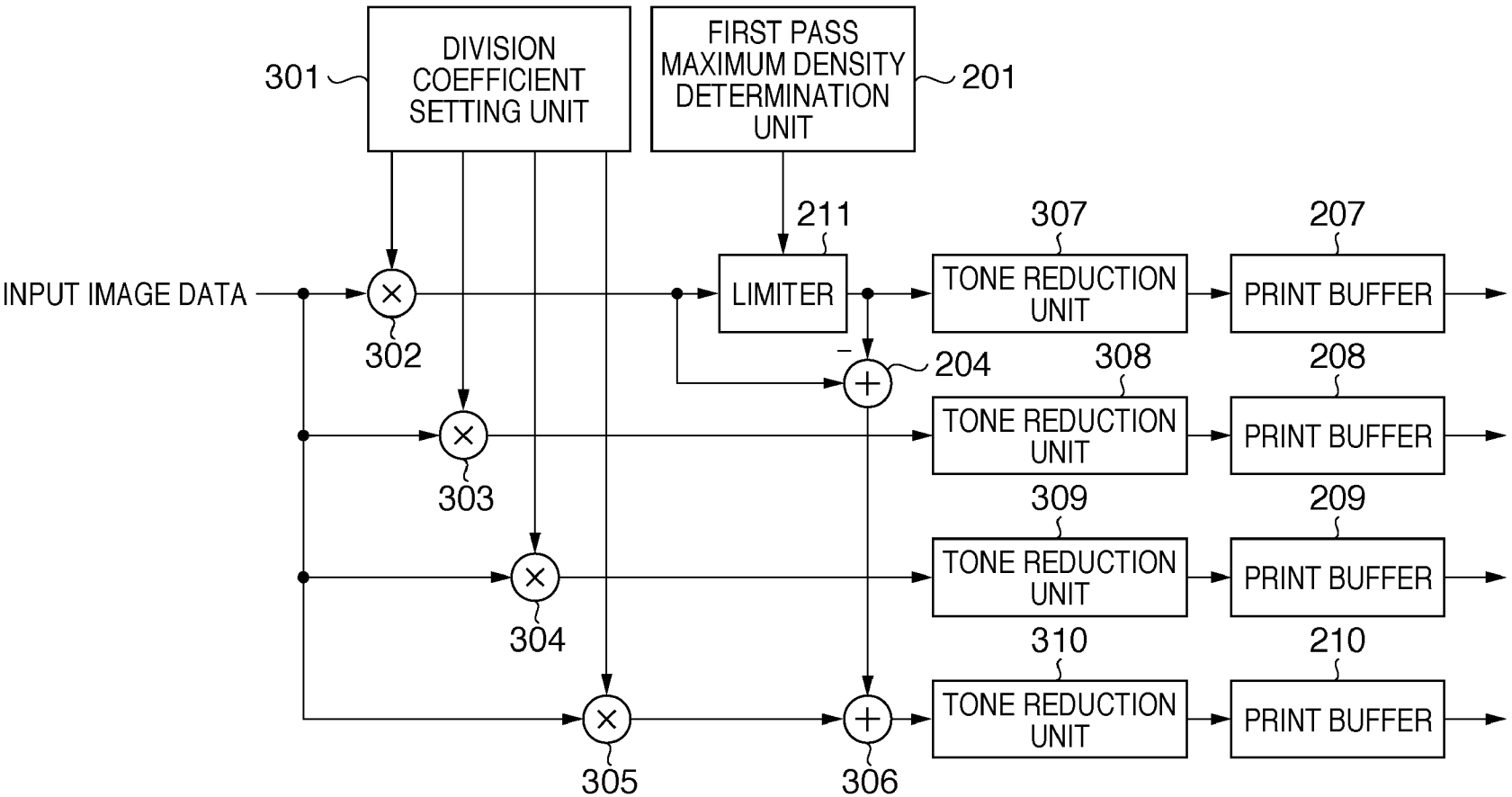
FIG. 10 is a block diagram showing the functional arrangement of a pass division data generation unit according to the second embodiment of the present invention.

FIG. 10 is a block diagram showing the functional arrangement of a pass division data generation unit 112 according to the second embodiment of the present invention. The same reference numerals as those in the first embodiment denote the same parts, and a description thereof will not be repeated.

A division coefficient setting unit 301 divides input image data into the densities of respective passes. Multipliers 302, 303, 304, and 305 multiply input image data by a division coefficient determined by a division coefficient determination unit 202. An adder 306 adds an output from a subtracter 204 to that from the multiplier 305. Tone reduction units 307, 308, 309, and 310 convert the image signals of respective passes into the number of tones outputtable by the printhead.

In the second embodiment, the division coefficient setting unit 301, and multipliers 302, 303, 304, and 305 divide input image data into the densities of respective passes. For example, for 4-pass equal division, the division coefficient setting unit 301 inputs a ¼ density of input image data to each of the multipliers 302, 303, 304, and 305. A density assigned to the first pass is limited to the maximum density of the first pass determined by a limiter 211. Overflow data upon limitation by the limiter 211 can be detected from the difference between the input and output of the limiter 211. The subtracter 204 calculates the overflow data and inputs it to the adder 306. The adder 306 adds the overflow data to the density of the fourth pass, correcting the densities of all the passes to make the sum of them equal to the input image data.

The tone reduction units 307, 308, 309, and 310 convert densities assigned to the respective passes into the number of tones expressible by the printhead. The output data are stored in print buffers 207, 208, 209, and 210, and printed by the printhead.

Since the multipliers 302, 303, 304, and 305 receive decimal fractions, they calculate values below the decimal point. To prevent an error, the tone reduction units 307, 308, 309, and 310 increase the number of input bits so as to receive even decimal fractions. For example, when the coefficient of the division coefficient setting unit 301 is ¼, density division can be achieved not by multiplication but by bit shift. In this case, lower two bits are input as a decimal fraction to each of the tone reduction units 307, 308, 309, and 310. The integer part becomes smaller by two bits upon the bit shift, and is directly input to the tone reduction unit without any process by the multiplier 302, 303, 304, or 305. To simplify the apparatus, the limiter 211, subtracter 204, and adder 306 process only the integer part, and do not process the decimal part.

As described above, according to the second embodiment, after input image data is divided into the densities of respective passes, the density of the first pass is limited to one at which no dots overlap each other. Dots corresponding to a shortage upon limiting the density can be compensated for by the final pass. Since overlapping of dots by the first pass which most influences the image quality can be prevented, streaking, a decrease in density, and the like can be suppressed, improving the image quality.

Third Embodiment

Figure 11:
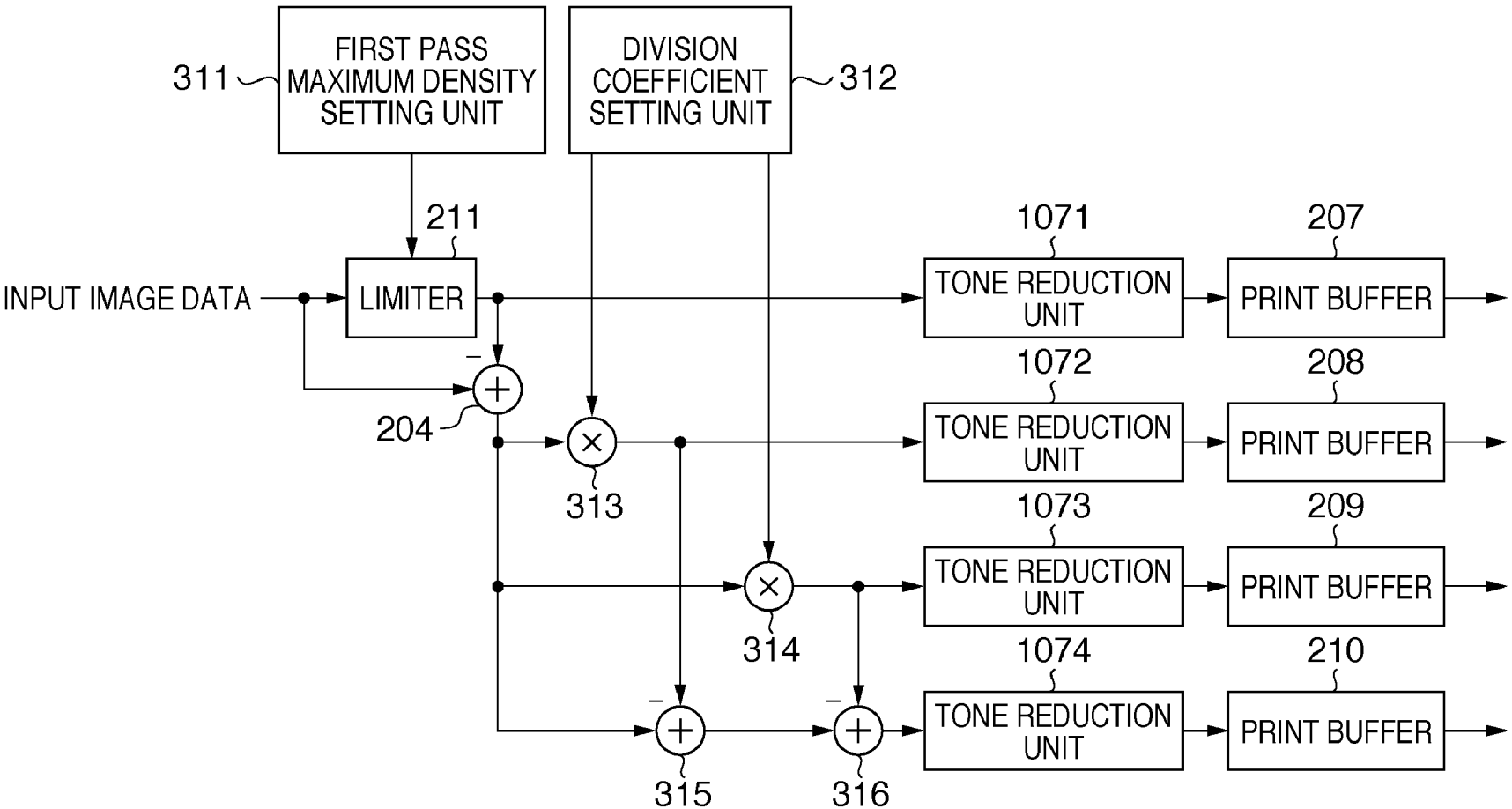
FIG. 11 is a block diagram showing the functional arrangement of a pass division data generation unit according to the third embodiment of the present invention.

FIG. 11 is a block diagram showing the functional arrangement of a pass division data generation unit 112 according to the third embodiment of the present invention. The same reference numerals as those in the first and second embodiments denote the same parts, and a description thereof will not be repeated.

A first pass maximum density setting unit 311 sets, in a limiter 211, the maximum density of the first pass determined by a CPU (not shown) or the like. A division coefficient setting unit 312 sets the division coefficients of passes (second and third passes in the third embodiment) except the first and final passes. Multipliers 313 and 314 multiply the difference between input image data and the density of the first pass by the division coefficients set by the division coefficient setting unit 312. Subtracters 315 and 316 subtract the densities of the second and third passes from the difference between the density output by the first pass and input image data.

First, the limiter 211 limits input image data, obtaining density data of the first pass. Then, the densities of the second and third passes are determined in accordance with values set by the division coefficient setting unit 312. The sum of the densities of the first to third passes is subtracted from input image data, obtaining the density of the fourth pass serving as the final pass.

When the density of input image data is equal to or lower than a value set by the first pass maximum density setting unit 311, an image is formed by the first pass. When the density of input image data exceeds a value set by the first pass maximum density setting unit 311, a density exceeding the set value is assigned to each pass.

Assume that a value set by the first pass maximum density setting unit 311 is 30, and values set by the division coefficient setting unit 312 are ¼ and ⅜. When the density of input image data is equal to or lower than 30, the input image data itself expresses the density of the first pass, and the densities of the remaining passes become 0. When the density of input image data exceeds 30, for example, is 240, the density of the first pass is 30, that of the second pass is $(240-30)\times\frac{1}{4}=52.5\approx52$, that of the third pass is $(240-30)\times\frac{3}{8}=78.75\approx78$, and that of the fourth pass is $240-30-52-78=80$. In actual calculation, the coefficient of the multiplier 313 is ¼, so the multiplier 313 executes 2-bit right shift operation. The coefficient of the multiplier 314 is ⅜, so the multiplier 314 multiplies the density by three and executes 3-bit right shift operation. For the fourth pass, the densities of the first to third passes are subtracted from the input image data, so the decimal parts calculated by the multipliers 313 and 314 are rounded down.

As described above, according to the third embodiment, input image data is limited to a value set by the first pass maximum density setting unit 311, obtaining density data of the first pass. The residual is multiplied by values set by the division coefficient setting unit 312, determining the densities of the second and third passes. The density of the fourth pass serving as the final pass is obtained by subtracting the sum of the densities of the first to third passes from the input image data. Thus, a simple arrangement can inhibit overlapping of dots by the first pass which most influences the image quality, preventing degradation of the image quality such as streaking and a decrease in density. When the maximum value of input image data for one scan operation is equal to or smaller than a value set by the first pass maximum density setting unit 311, printing can be completed by only the first pass, increasing the print speed.

Other Embodiments

The embodiments may also be applied to a system including a plurality of devices (e.g., a host computer, interface device, reader, and printer), or an apparatus (e.g., a copying machine, multi-function peripheral, or facsimile apparatus) formed by a single device.

The present invention may also be applied by supplying a computer-readable storage medium (or recording medium) which stores the computer program codes of software for implementing the functions of the above-described embodiments to a system or apparatus. The present invention may also be applied by reading out and executing the program codes stored in the storage medium by the computer (or the CPU or MPU) of the system or apparatus. In this case, the program codes read out from the storage medium implement the functions of the above-described embodiments, and the storage medium which stores the program codes constitutes the embodiments. Also, the present invention includes a case where an OS (Operating System) or the like running on the computer performs some or all of actual processes based on the instructions of the program codes and thereby implements the functions of the above-described embodiments.

The present invention also includes a case where the program codes read out from the storage medium are written in the memory of a function expansion card inserted into the computer or the memory of a function expansion unit connected to the computer, and the CPU of the function expansion card or function expansion unit performs some or all of actual processes based on the instructions of the program codes and thereby implements the functions of the above-described embodiments.

When the embodiments are applied to the computer-readable storage medium, the storage medium stores computer program codes corresponding to the above-described flowcharts and functional arrangements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-335058, filed Dec. 26, 2007, which is hereby incorporated by reference herein in its entirety.

What is claimed is:

1. An image forming apparatus which forms a halftone image on a print medium by using a multipass process to scan a printhead N (N is an integer of not less than 2) times in a single area on the print medium and form dots by each scan operation, the apparatus comprising:

a first print density setting unit configured to limit a print density of a scan operation in a first pass based on landing error information representing a positional error of a formed dot from an ideal position, so as to prevent dots from overlapping with each other on the print medium;

a second print density setting unit configured to set print densities of scan operations in second to Nth passes;

a print data generation unit generating print data of respective scan operations in accordance with the print densities set by the first print density setting unit and the second print density setting unit; and a printing unit printing the halftone image on the print medium based on the print data generated by the print data generation unit.

2. The apparatus according to claim 1, wherein the first print density setting unit sets, based on dot diameter information representing a diameter of a dot formed on the print medium and landing error information representing a error of a dot from a landing reference position, a maximum density at which dots do not overlap with each other on the print medium, and limits the print density to be not higher than the maximum density.

3. The apparatus according to claim 2, wherein when S denotes a sum of coefficients of the scan operations by the first to (m−1)th passes ($2 \leqq m \leqq N-1$, $3 \leqq N$), the second print density setting unit sets a positive coefficient K that satisfies $K+S<1$, and the second print density setting unit limits the print density of a scan operation in a (m)th pass to be not higher than a density obtained by multiplying, by the coefficient K, a difference between input image data and a value limited to be not larger than the maximum density.

4. The apparatus according to claim 1, wherein the second print density setting unit sets a print density of a scan operation in an Nth pass by subtracting, from input image data, a sum of values of the print densities of the scan operations by the first to (N−1)th passes.

5. The apparatus according to claim 1, further comprising a detection unit detecting whether formation of dots of input image data has ended, wherein when the detection unit detects that formation of all dots has ended, remaining scan operations are omitted.

6. An image forming method of forming a halftone image on a print medium by using a multipass process to scan a printhead N (N is an integer of not less than 2) times in a single area on the print medium and form dots by each scan operation, the method comprising:

a first print density setting step of limiting a print density of a scan operation in a first pass based on landing error information representing a positional error of a formed dot from an ideal position, so as to prevent dots from overlapping with each other on the print medium;

a second print density setting step of setting print densities of scan operations in second to Nth passes;

a print data generation step of generating print data of respective scan operations in accordance with the print densities set in the first print density setting step and the second print density setting step; and a printing step of printing the halftone image on the print medium based on print data generated in the print data generation step.

7. A computer-readable storage medium storing a computer program which is read and executed by a computer to cause the computer to execute the image forming method according to claim 6.

* * * * *